US009242779B1

(12) United States Patent
Schildcrout

(10) Patent No.: US 9,242,779 B1
(45) Date of Patent: Jan. 26, 2016

(54) RESEALING LABEL

(71) Applicant: Chai Holdings, LLC, Dallas, TX (US)

(72) Inventor: Andrew Schildcrout, Dallas, TX (US)

(73) Assignee: Chai Holdings, LLC, Dallas, TX (US)

( * ) Notice: Subject to any disclaimer, the term of this patent is extended or adjusted under 35 U.S.C. 154(b) by 0 days.

(21) Appl. No.: 14/220,900

(22) Filed: Mar. 20, 2014

(51) Int. Cl.

| | |
|---|---|
| ***B65D 41/62*** | (2006.01) |
| ***B65D 75/58*** | (2006.01) |
| ***B65B 7/16*** | (2006.01) |
| ***A47G 19/22*** | (2006.01) |

(52) U.S. Cl.
CPC . *B65D 75/58* (2013.01); *B65B 7/16* (2013.01); *A47G 19/2222* (2013.01); *B65D 41/62* (2013.01); *B65D 2231/02* (2013.01); *Y10T 428/14* (2015.01)

(58) Field of Classification Search
CPC ..... B65D 51/20; B65D 51/22; B65D 51/18; B65D 41/62; B65D 2251/0087; B65D 2251/0015; B65D 2231/02; A47G 19/2222; A47G 19/22; Y10T 428/14
See application file for complete search history.

(56) References Cited

U.S. PATENT DOCUMENTS

| | | | | |
|---|---|---|---|---|
| 3,711,011 | A | 1/1973 | Kugler | |
| 4,244,474 | A | 1/1981 | Wise | |
| 4,798,296 | A | 1/1989 | Lagerstedt et al. | |
| 4,858,766 | A | 8/1989 | Tsai | |
| 5,048,709 | A | 9/1991 | Alverson | |
| 5,833,368 | A | 11/1998 | Kaufman | |
| 5,984,135 | A | 11/1999 | Brown | |
| 5,992,658 | A * | 11/1999 | Berger | 215/232 |
| 6,334,711 | B1 | 1/2002 | Risgalla et al. | |
| 6,431,434 | B1 | 8/2002 | Haughton et al. | |
| 6,578,723 | B1 * | 6/2003 | Tyner | 215/232 |
| 6,716,396 | B1 * | 4/2004 | Anderson et al. | 422/501 |
| 7,175,581 | B2 | 2/2007 | Murray | |
| 7,798,360 | B2 | 9/2010 | Roberts | |
| 8,505,755 | B2 * | 8/2013 | Greenberg | 215/229 |
| 8,523,440 | B2 | 9/2013 | Walker et al. | |
| 8,603,278 | B2 | 12/2013 | Moore | |
| 2002/0185526 | A1 | 12/2002 | Tedford | |
| 2004/0074396 | A1 | 4/2004 | Murray | |
| 2005/0029270 | A1 | 2/2005 | Marshall | |
| 2006/0086744 | A1 * | 4/2006 | Li | 220/709 |
| 2006/0280391 | A1 | 12/2006 | Buggs | |
| 2008/0017652 | A1 * | 1/2008 | Roberts | 220/714 |
| 2008/0233424 | A1 | 9/2008 | Thorstensen-Woll et al. | |

FOREIGN PATENT DOCUMENTS

| | | | |
|---|---|---|---|
| CN | 201023873 | Y | 2/2008 |
| CN | 202624956 | U | 12/2012 |
| DE | 202006019446 | U1 | 2/2007 |
| DE | 102010052531 | B3 | 2/2012 |

OTHER PUBLICATIONS

International Search Report and Written Opinion mailed Jun. 29, 2015 in corresponding International Application No. PCT/US15/21509, 9 pages.

* cited by examiner

*Primary Examiner* — Patricia L Nordmeyer
(74) *Attorney, Agent, or Firm* — Gardere Wynne Sewell LLP

(57) ABSTRACT

A resealing label comprising a body and a puncturable portion formed through at least a portion of the body. The puncturable portion is formed of a puncturable material. The label further includes a retention member formed on the body, the retention member having at least one opening to receive an object therein to secure the object to the body.

20 Claims, 2 Drawing Sheets

RESEALING LABEL

TECHNICAL FIELD

This disclosure relates to labels, and more particularly, to adhesive labels for resealing beverage containers.

BACKGROUND OF THE DISCLOSURE

Beverage containers often include an opening that allows access to a liquid within the container. When the liquid is to be consumed, the container opening is opened to allow access to the liquid, oftentimes by piercing or puncturing the opening. The liquid may then be consumed or dispensed as the liquid exits the container through the punctured opening.

Beverage containers come in various sizes that include various amounts of liquid. While some beverage containers are sized to include an amount of liquid that can be consumed in a single serving, it is often the case that liquid remains in a beverage container after a serving of the liquid has been consumed. The remaining liquid is often difficult to store and may spill from the container. Unfortunately, the remaining liquid is often discarded rather than being saved for later consumption because of the difficulty of transporting and/or storing the remaining liquid.

SUMMARY

According to a first aspect, there is provided a resealing label for resealing an opening on a beverage container. The label includes a body having a top surface and a bottom surface. A puncturable portion is formed on at least a portion of the body and is formed of a puncturable material. The puncturable portion is sized to overlay the opening. An adhesive is disposed on the bottom surface to adhere the resealing label to the beverage container when the puncturable portion is aligned with and overlays the opening in order to seal the beverage container opening.

In other certain embodiments, the resealable label also includes a removable backing member secured to and overlaying the adhesive.

According to other embodiments, the puncturable portion includes a weakened portion of the body.

According to yet another embodiment, the puncturable portion includes a score line.

In certain embodiments, the puncturable portion is formed of a metallic material.

In other certain embodiments, the puncturable portion is constructed of a different material than the remainder of the body.

In still other embodiments, the body is formed having a top layer, a bottom layer, and the puncturable portion is disposed between the top layer and the bottom layer.

In yet another embodiment, the retention member includes a first opening and a second opening and a retention strip disposed between the first and second openings to secure the object.

In a second aspect, there is provided a method for resealing a drinking container having an opening therein. The method includes providing a resealable label having a body with a puncturable portion, aligning the puncturable portion with the opening of the container, and securing the resealable label to the container such that the puncturable portion overlays and seals the opening on the container.

According to some embodiments, securing the resealable label to the container includes securing the resealable label to the container with an adhesive.

In certain embodiments, aligning the puncturable portion with the opening of the container includes aligning the puncturable portion with an opening on a juice box.

In still other embodiments, the method further includes providing a retention member on the resealable label, the retention member having at least one opening to receive a straw.

In other certain embodiments, the method further includes puncturing the puncturable portion to reopen the container In yet other embodiments, the method includes resealing the container by the following steps: (i) providing a second resealable label having a body with a puncturable portion, (ii) aligning the puncturable portion with the opening of the container, and (iii) securing the second resealable label to the container such that the puncturable portion overlays and seals the opening on the container.

In a third aspect, there is provided a beverage container having an outer wall forming a storage area for storing liquid therein and an opening formed on the outer wall to facilitate access to the storage area. A resealing member removably secured to the outer wall, the resealing member including a puncturable portion formed through at least a portion of the resealing member and formed of a puncturable material, the resealing member removable from the outer wall and reattachable to the container such that the puncturable portion overlays and seals the opening on the outer wall to facilitate subsequent storage, transport and consumption of the unconsumed portion of the beverage within the container.

In a fourth aspect, there is provided a resealing apparatus for resealing a beverage container. The resealing apparatus includes a top layer having a top opening, a bottom layer having a bottom opening and a puncturable layer disposed between the top layer and the bottom layer. The top opening is aligned with the bottom opening to allow for puncturing of the puncturable layer without puncturing the top layer or the bottom layer. An adhesive is disposed on the bottom layer to adhere the resealing apparatus to the beverage container so that the top opening and the bottom opening are aligned with a pre-existing opening on the beverage container.

In certain embodiments, a backing layer is disposed on the adhesive to protect the adhesive from unintentional adhering prior to removal of the backing layer.

In other certain embodiments, the resealing apparatus further includes a retention member having a first opening, a second opening and a retention strip disposed between the first and second openings. The retention member is configured to support an object when the object is inserted through the first opening and the second opening.

In still other embodiments, the puncturable layer is formed of a material that is more easily punctured than the material of the top layer or bottom layer.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
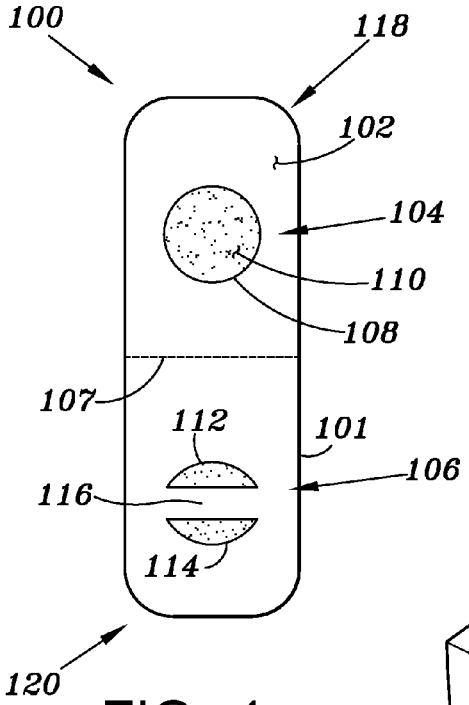
FIG. 1 is a top view of an embodiment of a resealing label in accordance with this disclosure.
Figure 2:
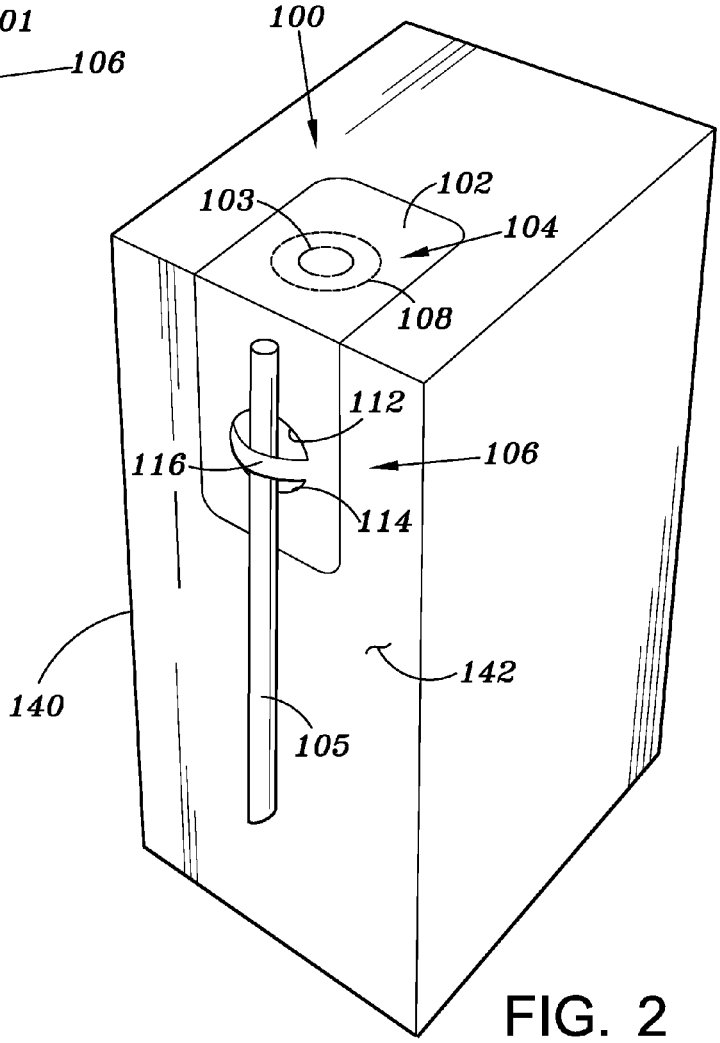
FIG. 2 is a perspective view of an embodiment of a resealing label coupled to a beverage container.
Figure 3:
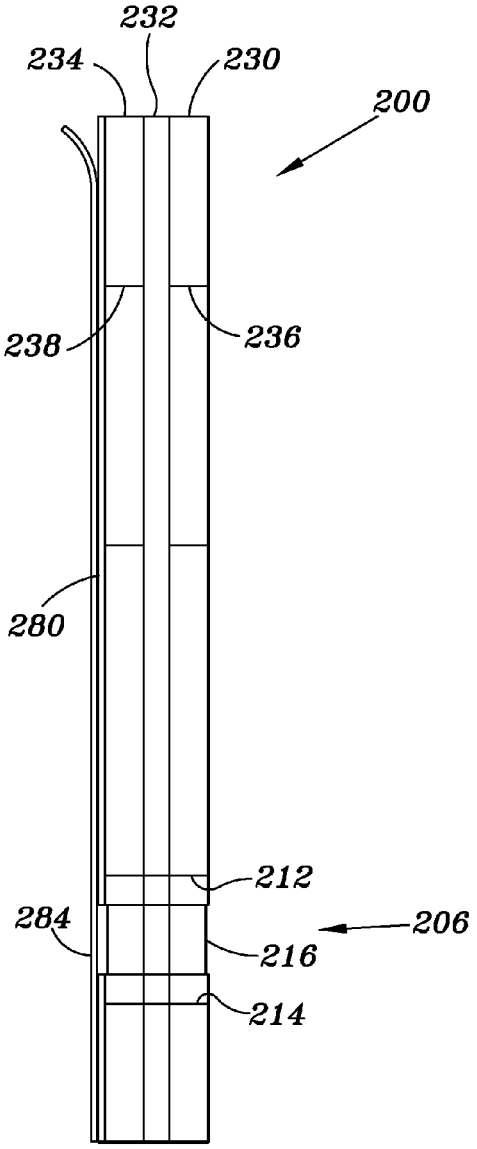
FIG. 3 is a cutaway side view of another embodiment of a resealing label in accordance with this disclosure.

FIGS. 1 and 2 illustrate an embodiment of a resealing label 100 for covering an opening 103 on a beverage or drinking container 140, such as, for example, a children's juice box or milk container. As illustrated in FIGS. 1 and 2, the label 100 includes a body 101 having a puncturable portion 104 that overlays and closes the opening 103, and a retention member 106 for retaining, as discussed in greater detail below, a straw 105 (FIG. 3). In use, the puncturable portion 104 is aligned with and otherwise positioned over the opening 103 of a partially-consumed container 140, which acts to seal the container 140 for subsequent storage, transport and consumption. As discussed in greater detail below, the resealing label 100 enables the contents inside the container 140 to be saved rather than discarded since the opening 103, and thus container 140, can be sealed. When it is desired to reopen the container 140 for consumption, the puncturable portion 104 is punctured (via the straw 105 or otherwise) to facilitate access to the liquid inside the container 140. If necessary, a second resealing label 100 can be placed over the first resealing label 100 to re-seal the container 140 for subsequent storage, transport and consumption.

As described above, the puncturable portion 104 is formed of a material to enable it to be punctured, torn, popped or otherwise opened in order to provide an opening through the label 100. In the embodiment of FIG. 1, for example, the puncturable portion 104 includes a main opening 108 enclosed by a puncture layer 110. The puncture layer 110 may be made of a material such as, for example, a thin metallic foil material or a plastic material. Regardless of the material, the puncturable portion 104 is formed so that it is easily punctured by a drinking straw, a user's finger/finger nail or any other object suitable for puncturing to create an opening therethrough to allow liquid passage from the container 140.

In other embodiments, the puncturable portion 104 includes weakened or scored portions of the label 100 that break away from the remainder of the label 100 when a force is applied thereto. For example, in some embodiments, the puncturable portion 104 includes a circular score line on the top surface 102 and/or bottom surface of the label 100 (i.e., the surface that contacts and/or otherwise abuts the container 140). In other embodiments, the puncturable portion 104 includes two score lines that intersect each other in the shape of a "T" or cross. In another embodiment, the puncturable portion 104 is a thinned region that can be easily punctured. In some embodiments, the entire label 100 is formed of a puncturable material. In addition, the puncturable portion 104 can include indicia, such as a printed circle or an "X", to help the user align the label 100, and in particular, align the puncturable portion 104 over the pre-existing opening 103 of the container 140.

Referring specifically to FIGS. 1 and 2, the retention member 106 may be any mechanism suitable for securing the object 105 to the label 100, and thus, the container 140. In one embodiment, the retention member 106 includes a first opening 112, a second opening 114 and a retention strip 116 disposed between the first and second openings 112 and 114. The first opening 112 and the second opening 114 extend through the label 100 to enable an object, such as the drinking straw 105, to be threaded through the first opening 112, positioned under the retention strip 116 and through the second opening 114, as best illustrated in FIG. 2. In this manner, a straw 105 or other object, typically sold and/or used with a children's juice box or milk container, may be removably stored with the juice box or milk container. According to some embodiments, the retention strip may be formed of a stretchable or otherwise elastic material to secure the straw 105 therethrough.

In other embodiments, the retention strip 116 is formed to protrude from the top surface 102 of the label 100 to facilitate placing an object through the first opening 112, under the retention strip 116 and through the second opening 114. In some embodiments, the bottom surface of the retention strip 116 (i.e., the surface that faces or abuts the container 140) does not include an adhesive so that the retention strip 116 will not adhere to the container 140 when the label 100 is adhered to the container 140. As such, the retention strip 116 can be pulled and/or otherwise deformed away from the container 140 to place an the straw 105 or other object between the retention strip 116 and the container 140. In the embodiment illustrated in FIG. 1, the retention strip 116 is formed integral with the label 100; however, it should be understood that the retention strip 116 may be separately attached to the label 100, such as a separate piece of material that is otherwise secured to the label 100. Furthermore, while the puncturable portion 104 is located adjacent a first end 118 of the resealing label 100 and the retention member 106 is located adjacent a second end 120 of the resealing label 100, the puncturable portion 104 and the retention member 106 may be located at any other suitable location on the resealing label 100.

In other embodiments, the retention member 106 includes two scored or weakened areas on either side of a retention strip 116. Thus, when the retention member 106 is to be used, the scored or weakened areas are punctured so that the straw 105 or other object can be placed under the retention strip 116 as previously discussed.

According to embodiments disclosed herein, the label 100 is formed of any suitable material, such as paper, plastic, or may be metallic, and may include combinations thereof. For example, in some embodiments, the label 100 includes an area that is made of a material that can be marked with a pen or marker, for example, to place the name of the user. In other embodiments, the label 100 may include foil materials, such as a metal foil or a plastic foil. According to embodiments disclosed herein, the label 100 may be constructed of a single layer of material or, as discussed in greater detail below, be constructed of multiple layers that are fused, molded, glued or otherwise adhered to each other. The label 100 may be any suitable shape, such as, for example, rectangular, circular or triangular in shape. In some embodiments, the shape of the label 100 is customized to fit on a particular container 140.

In the embodiment illustrated in FIGS. 1 and 2, the label 100 includes an adhesive (not shown) on all or a portion the bottom surface of the label 100. In some embodiments, the label 100 includes a second layer (not shown), such as for example, a backing strip, which is attached to the adhesive so that the label 100 can be stored without exposing the adhesive. Thus, when the label 100 is to be used, the backing layer is peeled away and/or otherwise removed to expose the adhesive to facilitate application of the label 100 to the container 140. In some embodiments, the backing layer may also include an adhesive thereon to allow the backing layer to be adhered to a surface, such as the surface of the container 140. Thus, for example, the backing layer can be adhesively attached to the container 140 during manufacture and prior to the sale of the container 140. When it is desired to use the label 100, the label 100 is peeled away and/or otherwise removed from the backing layer, which remains adhered to the container 140. The exposed adhesive is used to secure the label 100 to the container 140 and over the opening 103, as previously discussed.

In some embodiments, the label 100 is formed without a retention member 106. In yet other embodiments, the label 100 is formed without a puncturable portion 104 and only a retention member 106. In other embodiments, the retention member 106 is removable or otherwise separable from the portion of the label 100 that includes the puncturable portion 104. For example, in some embodiments, a score line, perforation line or other weakened line 107 (FIG. 1) is formed between the retention member 106 and the puncturable portion 104 on the label 100 to facilitate tearing and separation of the label 100 along the line 107. In other embodiments, the label 100 includes two separate portions. In such an embodiment, the puncturable portion 104 is be located on a first portion of the label 100 and the retention member 106 is located on a separate, second portion of the label 100. As such, the first portion of the label 100 that includes the puncturable portion 104 may be adhered to a beverage container so that the puncturable portion 104 covers the opening 103 of the container 140 and the portion of the label 100 that includes the retention member 106 may be separately adhered to a side 142 surface of the container 140.

According to some embodiments, the label 100 is formed of a substantially flat, flexible material or, in the alternative, the label 100 is preconfigured in a specified shape. For example, in some embodiments, the puncturable portion 104 and surrounding portions of the label 100 are creased or otherwise bent so that the puncturable portion 104 can be easily adhered on a valley-shaped surface, such as a valley-shaped surface found on some juice pouch containers. According to some embodiments, the adhesive is a food-grade adhesive and the label 100 is formed of a food-grade material.

FIG. 3 is a side view of another embodiment of a sealing label 200 that includes a top layer 230, a bottom layer 234 having an adhesive 280, a middle layer 232 disposed between the top and bottom layers 230 and 234, and an optional backing layer 284 attached to the adhesive layer. In FIG. 3, the top layer 230 includes a top opening 236 that is aligned with a bottom opening 238 in the bottom layer 234. In some embodiments, the perimeter of the top opening 236 is coextensive with the perimeter of the bottom opening 238 and the middle layer 232, which is formed of a puncturable material, is disposed between and otherwise exposed via the openings 236 and 238. Thus, in use, a user inserts an object, such as, for example, a straw, through the resealing label 200 by entering the top opening 236, puncturing the middle layer 232 and then exiting through the bottom opening 238. In some embodiments, the top and bottom layers 230 and 234 are made of a plastic material and the middle layer 232 is made of a thin, and easily puncturable metal material that may include a thin plastic coating. While the middle layer 232 is shown to be co-extensive with the top and bottom layers 230 and 234, the middle layer 232 may be smaller or larger than the top and bottom layers 230 and 234. Similarly, the top and bottom layers 230 and 234 may be coextensive or the top layer 230 may be larger or smaller than the bottom layer 234.

In the embodiment illustrated in FIG. 3, the retention member 206 includes a first opening 212, a second opening 214 and a retention strip 216 disposed between the openings 212 and 214. The first and second openings 212 and 214 pass through all or part of the top layer 230, the middle layer 232 and/or the bottom layer 234. The retention strip 216 is located between the first opening 212 and the second opening 214 and is detachable from the middle layer 232 or the bottom layer 234, depending on which layers 230, 232 and/or 234 are passed through by the first opening 212 and the second opening 214. In some embodiments, for example, the first opening 212 and the second opening 214 pass through at least a portion of the top layer 230 and the retention strip 216 is formed by the portion of the top layer 230 between the first opening 212 and the second opening 214. In some embodiments, the first opening 212 and the second opening 214 pass through the top layer 230 and the middle layer 232 and the retention strip 216 is formed by the top layer 230 and the middle layer 232.

As described above, the bottom layer 234 may include an adhesive 280 or may be formed of an adhesive material. In some embodiments, the exposed portion of the middle layer 232 may also include an adhesive (not shown). The adhesive 280 allows the resealing label 200 to be secured to a beverage container to seal a pre-existing opening of the beverage container. All or only parts of the bottom layer 234 may include the adhesive 280. For example, the retention strip 216 may not include the adhesive 280, as shown in FIG. 2.

Referring again to FIG. 2, the retention member 106 is secured to a lateral side 142 of the container 140. In some embodiments, for example, a user may consume some of the liquid in the container 140 using a straw that was included with the container 140. If the user does not consume all of the liquid in the container 140, the user may place a label 100 on the container 140 so that the puncturable portion 104 is positioned over the pre-existing opening 103 and the retention member 306 is secured to the container 140, and as shown in the embodiment illustrated in FIG. 2, the lateral side 142 of the container 140. The user may then place the straw 105 in the retention member 106 by placing the straw 105 through the first opening 312, under the retention strip 116 and then through the second opening 114. In this manner, the retention strip 116 holds the straw 105 against and with the beverage container 140 so that the straw 105 can be transported and stored with the beverage container 140 and then reused. When the user desires to consume more liquid in the container 140, the user removes the straw 105 from the retention member 106 and uses an end of the straw to puncture the puncturable portion 104 to gain access to the contents inside the container 140. If further storage of the contents inside the container 140 is desired, a second label 100 can be used to overlay the first label 100 and subsequently punctured as previously described.

Figure 4:
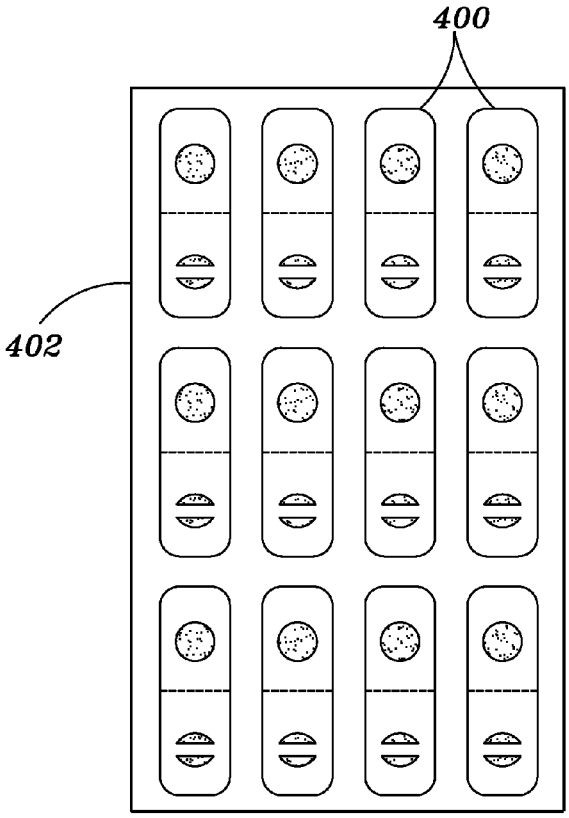
FIG. 4 is a top view of a sheet that includes a plurality of resealing labels in accordance with this disclosure.

FIG. 4 shows a top view of a sheet 402 that includes a plurality of sealing labels 400. The labels 400 may be secured to the sheet 402 by the adhesive that is later used to secure the label 400 to the container 340. In other embodiments, the sealing labels 400 include a second or backing layer (such as backing layer 284 in FIG. 3) having an adhesive thereon so that the second or backing layer is secured to the sheet 402. As such, the label 400 can be removed from the sheet 402 with the second or backing layer attached to the label 400 so that the adhesive of the label 400 is not yet exposed. The backing layer can later be removed from the label 400 to expose the adhesive of the label 400 when the label 400 is ready to be placed on a beverage container 140. In some embodiments, the backing layer may be employed without an adhesive thereon such that the label can be transported in a purse, a pocket, or otherwise, and then when it is desired to use the label 400, the backing can be peeled away to expose the adhesive layer for securing to the container 140. According to some embodiments, extra straws 105 may be pre-packaged with the sheet 402 or one or more labels 400 for subsequent use therewith.

In the foregoing description of certain embodiments, specific terminology has been resorted to for the sake of clarity.

However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of." A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, while invention(s) have been described in connection with what are presently considered to be the most practical and preferred embodiments, it is to be understood that the inventions are not to be limited to the disclosed embodiments. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A resealing label, the label comprising:

a puncturable portion for positioning on an opening of a partially-consumed beverage container to seal the opening of the partially-consumed beverage container;

a retention portion for retaining a used drinking object that was previously secured to the partially-consumed beverage container, wherein the retention portion secures the drinking object to the partially-consumed beverage container outside of a liquid containing portion of the partially-consumed beverage container; and an adhesive for securing at least part of the puncturable portion over the opening of the partially-consumed beverage container.

2. The label of claim 1, wherein the retention portion includes at least one opening for securing the drinking object to the partially-consumed beverage container outside of a liquid containing portion of the partially-consumed beverage container.

3. The label of claim 1, wherein the partially-consumed beverage container is rectangular and the opening is positioned on a first, top surface of the beverage container, wherein the adhesive secures at least part of the puncturable portion to the first surface and secures at least part of the retention portion to a second, lateral surface of the beverage container, wherein the first surface is perpendicular to the second surface.

4. The label of claim 3, wherein the drinking object is a straw and the straw is parallel to the second surface when held within the at least one opening of the retention portion.

5. The label of claim 1, wherein the drinking object is removable from the retention portion.

6. The label of claim 1, further comprising a removable backing layer coupled to the adhesive to protect the adhesive from unintentional adhering prior to removal of the backing layer.

7. The label of claim 1, wherein the puncturable portion is constructed of a different material than the retention portion.

8. A resealing label, the label comprising:

a body comprising a puncturable portion and a retention portion;

an adhesive on the body; and a backing layer coupled to the body by the adhesive, wherein the backing layer is removable from the body to expose the adhesive;

wherein the puncturable portion is positioned on the body portion to allow for securing the puncturable portion over an opening of a beverage container, wherein the retention portion removably secures a drinking object to the beverage container outside of a liquid containing portion of the beverage container.

9. The label of claim 8, wherein the puncturable portion comprises a layer of puncturable material.

10. The label of claim 8, wherein the adhesive is positioned on the retention portion but not on the puncturable portion.

11. A resealing label for resealing an opening on a beverage container, the label comprising:

a body having a top surface and a bottom surface;

a puncturable portion formed on at least a portion of the body, the puncturable portion formed of a puncturable material and sized to overlay at least a portion of the opening;

a retention portion formed on at least a portion of the body; and an adhesive disposed on the bottom surface to adhere the puncturable portion to the beverage container when the puncturable portion is aligned with the opening, wherein the retention portion secures a drinking object to the beverage container outside of a liquid containing portion of the beverage container.

12. The resealing label of claim 11, wherein the retention member includes at least one opening to receive the drinking object therein to secure the drinking object to the body.

13. The resealing label of claim 11, further comprising a removable backing member secured to and overlaying the adhesive.

14. The resealing label of claim 11, wherein the puncturable portion comprises a weakened portion of the body.

15. The resealing label of claim 11, wherein the drinking object is a straw.

16. The resealing label of claim 11, wherein the puncturable portion comprises a metallic material.

17. The resealing label of claim 11, wherein the puncturable portion is constructed of a different material than a remainder of the body.

18. The resealing label of claim 11, wherein the body is formed having a top layer, a bottom layer, and the puncturable layer between the top layer and the bottom layer, wherein the puncturable portion comprises a top opening in the top layer, a bottom opening in the bottom layer and a portion of the puncturable layer between the top opening and the bottom opening.

19. The resealing label of claim 11, wherein the retention portion includes a first opening, a second opening and a retention strip disposed between the first and second openings to secure the drinking object.

20. The resealing label of claim 11, wherein the adhesive adheres the retention portion to a side surface of the beverage container.

* * * * *